US010423119B2

(12) United States Patent
Kawamura et al.

(10) Patent No.: US 10,423,119 B2
(45) Date of Patent: Sep. 24, 2019

(54) IMAGE FORMING APPARATUS INCLUDING A PRESSING MEMBER CONFIGURED TO PRESS A DEVELOPMENT UNIT

(71) Applicant: CANON KABUSHIKI KAISHA, Tokyo (JP)

(72) Inventors: Tomofumi Kawamura, Suntou-gun (JP); Shoichi Zensai, Yokohama (JP); Takashi Yano, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/058,835

(22) Filed: Aug. 8, 2018

(65) Prior Publication Data

US 2018/0348696 A1 Dec. 6, 2018

Related U.S. Application Data

(63) Continuation of application No. 15/455,015, filed on Mar. 9, 2017, now Pat. No. 10,073,408.

(30) Foreign Application Priority Data

Mar. 11, 2016 (JP) ..... 2016-048858
Feb. 14, 2017 (JP) ..... 2017-025410

(51) Int. Cl.
*G03G 21/16* (2006.01)
*G03G 21/18* (2006.01)

(52) U.S. Cl.
CPC ..... *G03G 21/1647* (2013.01); *G03G 21/1633* (2013.01); *G03G 21/1676* (2013.01); *G03G 21/1842* (2013.01); *G03G 21/185* (2013.01); *G03G 2215/0132* (2013.01); *G03G 2221/1684* (2013.01)

(58) Field of Classification Search
CPC ..... G03G 21/1647; G03G 21/1633; G03G 21/1842; G03G 21/1676; G03G 21/1684; G03G 21/185; G03G 2215/0132
See application file for complete search history.

(56) References Cited

U.S. PATENT DOCUMENTS

2005/0053394 A1* 3/2005 Ishii ..... G03G 21/1821 399/111
2005/0191089 A1* 9/2005 Nishimura ..... G03G 21/1825 399/111

(Continued)

*Primary Examiner* — G. M. A Hyder
(74) *Attorney, Agent, or Firm* — Canon U.S.A., Inc. I.P. Division

(57) ABSTRACT

An image forming apparatus includes a mounting unit configured to mount a development unit including a developing member, a pressing member configured to press the development unit mounted on the mounting unit to separate the developing member from a photosensitive member or bring the developing member into contact with the photosensitive member, and an urging member configured to urge the pressing member, wherein, when mounting the development unit on the mounting unit, the development unit moves in a first direction from the pressing member toward the development unit, parallel to a direction in which the pressing member and the development unit are arranged side by side, wherein the pressing member is movable in the first direction, and wherein the urging member urges the pressing member to move the pressing member in the first direction.

10 Claims, 17 Drawing Sheets

(56) References Cited

U.S. PATENT DOCUMENTS

| | | | | |
|---|---|---|---|---|
| 2005/0191090 | A1* | 9/2005 | Nishimura | G03G 21/1821 399/113 |
| 2007/0071495 | A1* | 3/2007 | Hashimoto | G03G 21/1821 399/111 |
| 2007/0160388 | A1* | 7/2007 | Yoshimura | G03G 21/1825 399/111 |
| 2008/0138115 | A1* | 6/2008 | Chadani | G03G 21/186 399/167 |
| 2010/0202797 | A1* | 8/2010 | Kikuchi | G03G 21/1623 399/111 |
| 2010/0221039 | A1* | 9/2010 | Kawai | G03G 21/1623 399/121 |
| 2012/0269545 | A1* | 10/2012 | Morita | G03G 21/1825 399/111 |
| 2013/0051851 | A1* | 2/2013 | Fukamachi | G03G 21/1821 399/113 |
| 2013/0100225 | A1* | 4/2013 | Kodo | G03G 15/00 347/224 |
| 2013/0164030 | A1* | 6/2013 | Anan | G03G 21/1828 399/111 |
| 2014/0169833 | A1* | 6/2014 | Kawamura | G03G 21/1825 399/222 |
| 2015/0063834 | A1* | 3/2015 | Kobayashi | G03G 15/043 399/12 |
| 2017/0248171 | A1* | 8/2017 | Kawamura | F16D 11/14 |
| 2017/0261918 | A1* | 9/2017 | Zensai | G03G 21/1633 |
| 2017/0261920 | A1* | 9/2017 | Kawamura | G03G 21/1647 |
| 2017/0261921 | A1* | 9/2017 | Kawamura | G03G 21/1647 |

* cited by examiner

IMAGE FORMING APPARATUS INCLUDING A PRESSING MEMBER CONFIGURED TO PRESS A DEVELOPMENT UNIT

CROSS REFERENCE TO RELATED APPLICATIONS

The present application is a Continuation of U.S. patent application Ser. No. 15/455,015, filed on Mar. 9, 2017, which claims priority from Japanese Patent Application No. 2016-048858 filed Mar. 11, 2016 and Japanese Patent Application No. 2017-025410 filed Feb. 14, 2017, all of which are hereby incorporated by reference herein in their entirety.

BACKGROUND OF THE INVENTION

Field of the Invention

The present embodiments relate to an image forming apparatus, such as a copying machine, a printer, and a facsimile, in which an exterior cover is opened and closed and a process cartridge mounted inside the apparatus is removed or replaced.

Description of the Related Art

In a certain configuration, an image bearing member (photosensitive drum) with a toner image formed thereon and an image forming unit (developing roller) are configured as a cartridge removably mounted on an image forming apparatus main body (apparatus main body), facilitating the replacement of consumables and other maintenance works.

With this cartridge of contact development type, development is performed by bringing the photosensitive drum into contact with the developing roller at the time of image formation. From the viewpoint of the life of a photosensitive drum and a developing roller, the contact development type is configured so that a pressing member of the apparatus main body presses a development container of the cartridge to switch the photosensitive drum and the developing roller between a contact state and a separation state.

Japanese Patent Application Laid-Open No. 2013-246247 discusses two different processes for mounting a cartridge in an apparatus main body: a process for moving the cartridge in the axial direction of a photosensitive drum (insertion process), and a process for moving the cartridge having a directional component perpendicularly intersecting with the axial direction and separating from a pressing member (positioning process). Japanese Patent Application Laid-Open No. 2013-246247 discusses a configuration corresponding to the insertion process and the positioning process, i.e., a configuration of a pressed portion of a development container pressed by a pressing member in a state where the pressing member and a cartridge have been mounted.

More specifically, in the configuration discussed in Japanese Patent Application Laid-Open No. 2013-246247, the pressed portion is disposed at a protruding portion protruding from the development container and positioned at a position distant to some extent from the root of the protruding portion protruding from the development container.

In the configuration discussed in Japanese Patent Application Laid-Open No. 2013-246247, it is necessary that the pressed portion does not interfere with the apparatus main body in the insertion process and that the pressing member can press the pressed portion even if the cartridge moves in the direction away from the pressing member in the positioning process. Therefore, it is necessary to provide the pressed portion at a position distant to some extent from the root of the protruding portion. Therefore, if the pressing member presses the pressed portion with the cartridge mounted, the protruding portion of the development container may be elastically deformed or creep-deformed when the pressed portion is pressed by the pressing member. Such a deformation of the protruding portion may possibly cause the loss of the amount of separation of the developing roller from the photosensitive drum when separating the developing roller from the photosensitive drum or the loss of the amount of contact pressure of the developing roller onto the photosensitive drum when bringing the developing roller into contact with the photosensitive drum.

When the pressing member is moved by a predetermined amount while pressing the pressed portion, the protruding portion of the development container is deformed and therefore the amount of separation of the developing roller from the photosensitive drum becomes smaller than the separation amount in a case where the development container is a rigid body. The loss of the separation amount refers to this amount of reduction in the separation amount. Therefore, to secure a predetermined separation amount, it has been necessary to increase the moving amount of the pressing member for separating the developing roller from the photosensitive drum taking the loss of the separation amount into consideration.

When the pressing member is moved by a predetermined amount while pressing the pressed portion, the protruding portion of the development container is deformed and therefore the contact pressure for bringing the developing roller into contact with the photosensitive drum becomes smaller than the contact pressure in a case where the development container is a rigid body. The loss of the contact pressure refers to this amount of reduction in the contact pressure. Therefore, to secure a predetermined contact pressure, it has been necessary to increase the moving amount of the pressing member for bringing the developing roller into contact with the photosensitive drum taking the loss of the contact pressure into consideration.

To gain the moving amount of the pressing member required to ensure the predetermined separation amount or the predetermined contact pressure taking the above-described losses into consideration, a space which is large to some extent needs to be allocated to allow the pressing member to move in the apparatus main body. Therefore, it has been difficult to downsize the apparatus main body.

SUMMARY OF THE INVENTION

The present disclosure is directed to the provision of a configuration having a pressing member capable of pressing a portion of a development container which is hardly deformed when a developing roller is separated.

The present disclosure is also directed to the provision of the following image forming apparatus.

According to an aspect of the present disclosure, an image forming apparatus includes a mounting unit configured to mount a development unit including a developing member, a pressing member configured to press the development unit mounted on the mounting unit to separate the developing member from a photosensitive member or bring the developing member into contact with the photosensitive member, and an urging member configured to urge the pressing member. When mounting the development unit on the mounting unit, the development unit moves in a first direction from the pressing member toward the development unit, parallel to a direction in which the pressing member and the development unit are arranged side by side. The pressing member is movable in the first direction. The urging member urges the pressing member to move the pressing member in the first direction.

Further aspects of the present disclosure will become apparent from the following description of exemplary embodiments with reference to the attached drawings.

DESCRIPTION OF THE EMBODIMENTS

<Overall Schematic Configuration of Image Forming Apparatus>

Figure 1:
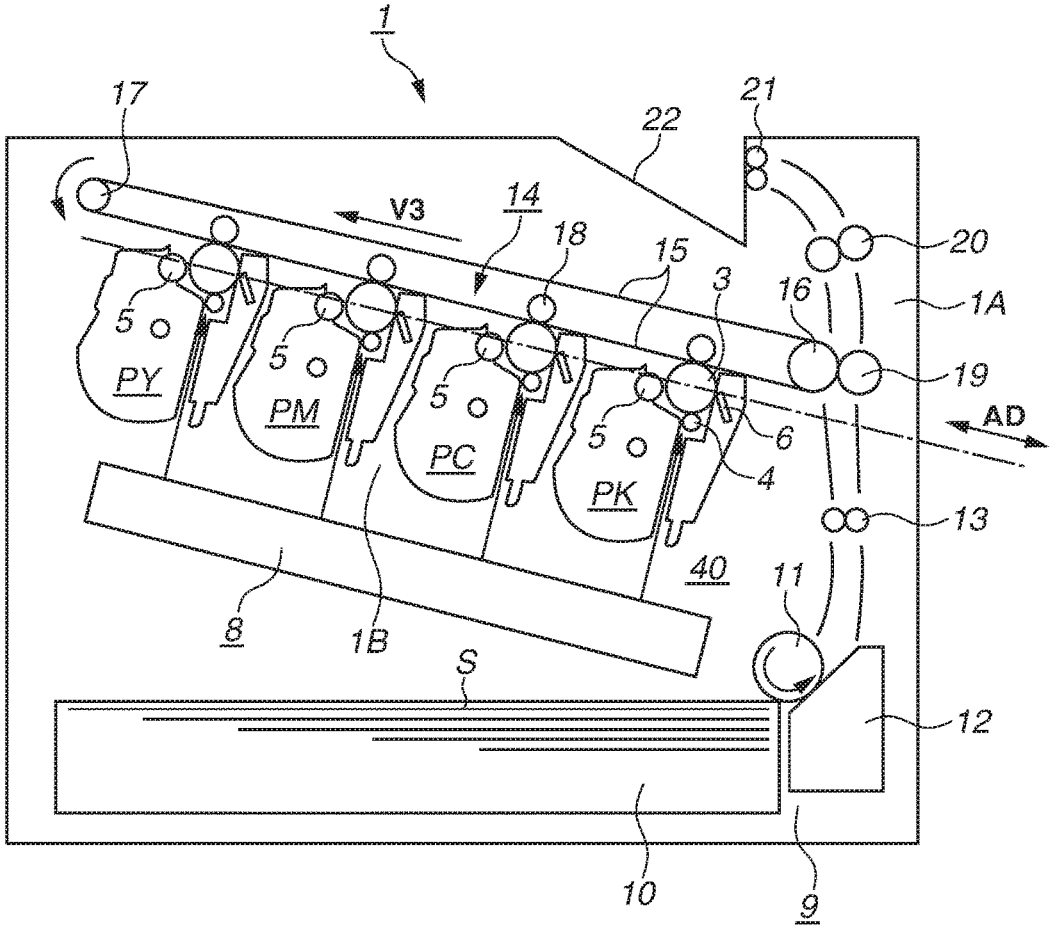
FIG. 1 is a cross-sectional view schematically illustrating an image forming apparatus.
Figure 2:
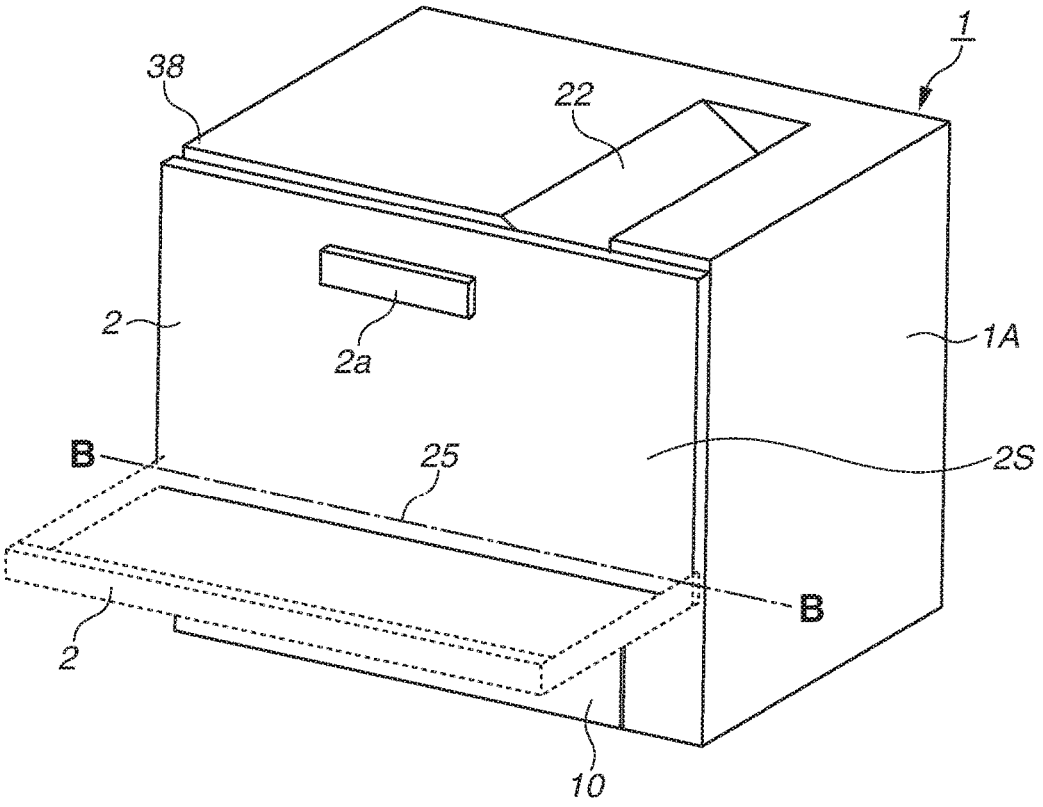
FIG. 2 is a perspective view illustrating an outer appearance of the image forming apparatus with a front door closed.
Figure 3:
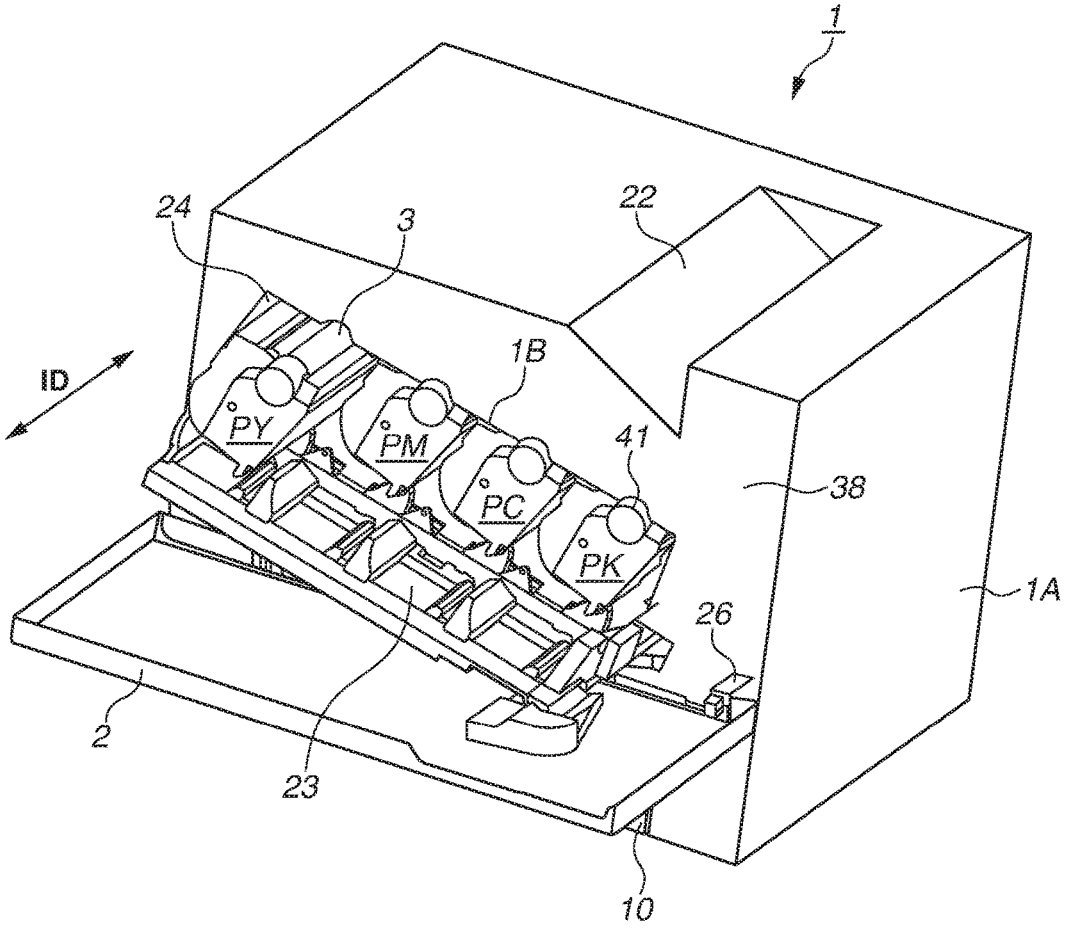
FIG. 3 is a perspective view illustrating an outer appearance of the image forming apparatus with the front door opened and a first cartridge pulled out halfway.

FIG. 1 is a cross-sectional view schematically illustrating an image forming apparatus 1 according to the present exemplary embodiment. FIG. 2 is a perspective view illustrating an outer appearance of the image forming apparatus 1 with a front door (exterior cover) 2 closed. FIG. 3 is a perspective view illustrating an outer appearance of the image forming apparatus 1 with the front door 2 opened and a first process cartridge PY pulled out halfway.

The image forming apparatus 1 is a four-color full-color electrophotographic laser beam printer for forming a color image on a recording medium. The image forming apparatus 1 of cartridge mountable/removable type uses four different process cartridges (hereinafter referred to as cartridges) P. The process cartridges P include a first cartridge PY, a second cartridge PM, a third cartridge PC, and a fourth cartridge PK which are removably mounted on an image forming apparatus main body 1A.

The front side of the image forming apparatus 1 according to the exemplary embodiments refers to the side on which the front door 2 is disposed. The rear side or back side refers to the opposite side of the front side. The longitudinal direction refers to the direction directed from the back side toward the front side (forward direction) and the opposite direction (backward direction). The right and left refers to the respective right- and left-hand sides, when viewed from the front side of the image forming apparatus 1. The lateral direction refers to the direction directed from right to left (leftward direction) and the opposite direction (rightward direction). The image forming apparatus main body (hereinafter referred to as an apparatus main body) 1A refers to portions of the image forming apparatus 1 other than the cartridges P. In the descriptions of the present exemplary embodiment, the longitudinal direction (LD) of the cartridge P is the direction parallel to the direction of the rotational axis (axial direction) of an electrophotographic photosensitive drum (hereinafter referred to as a drum) 3 serving as a photosensitive member (image bearing member). With the cartridge P, the side to which a driving force is transmitted from the apparatus main body 1A in the longitudinal direction (LD) (the side on which the portion receiving the driving force from the apparatus main body 1A is disposed) is referred to as a drive side, and the opposite side of the drive side is referred to as a non-drive side.

A cartridge storage unit 1B for storing the cartridges P is disposed at the central portion in the apparatus main body 1A. The cartridge storage unit 1B is also a mounting unit for mounting the cartridges P after being inserted.

The cartridges P have a similar electrophotographic process mechanism, with different colors of the developing agent (hereinafter referred to as toner) and different filling amounts of toner. In the cartridge storage unit 1B, the cartridges P mounted at such positions that an image can be formed is provided with a rotational driving force transmitted from the apparatus main body 1A and supplied with biases including a charging bias and a development bias (not illustrated).

In a cartridge frame 40 of the cartridge P according to the present exemplary embodiment, a drum 3 and process units (a charging unit 4, a development unit 5, and a cleaning unit 6) for acting on the drum 3 are integrally assembled. A charging roller is used as the charging unit 4. A developing roller 45 which is a developing member is used as the development unit 5. In a state where the cartridge P is mounted on the apparatus main body 1A and positioned, the direction of the rotational axis (axial direction) of the developing roller 45 is parallel to the axial direction of the drum 3. A cleaning blade is used as the cleaning unit 6. At the lower portion of each cartridge P, a laser scanner 8 is disposed as an image information exposure unit for the drum 3.

A feeding unit 9 is disposed under the laser scanner 8. The feeding unit 9 includes a sheet supplying cassette 10 for stacking and storing recording materials (transfer materials or final recording media) S, a feed roller 11, a separation unit 12, and a registration roller pair 13.

An intermediate transfer unit 14 is disposed above the four cartridges P. The intermediate transfer unit 14 is a primary transfer member for superimposing the toner images formed on the drums 3 of the first, the second, the third, and the fourth cartridges PY, PM, PC, and PK onto an intermediate transfer belt (a first recording medium, hereinafter referred to as a transfer belt) 15. The intermediate transfer unit 14 includes a driving roller 16 and a tension roller 17 which are in parallel disposed on the right-hand side and the left-hand side. The flexible endless transfer belt 15 is stretched between the two rollers 16 and 17. The transfer belt 15 is disposed so as to be inclined with respect to the horizontal direction.

In the cartridge storage unit 1B, the upper surface of the drum 3 of the cartridge P mounted at such a position that an image can be formed is in contact with the undersurface of a belt portion of the transfer belt 15 on the lower running side. The contact portion is a primary transfer portion. Inside the transfer belt 15, primary transfer rollers 18 are disposed to face the respective drums 3. In a state where the belt portions of the transfer belt 15 on the lower running side are in contact with the upper surfaces of all of the drums 3, the transfer belt 15 is circularly driven by the driving roller 16 at the speed corresponding to the rotational speed of the drums 3 in the direction of the arrow V3. The primary transfer rollers 18 are applied with a predetermined primary transfer voltage at a predetermined control timing. The driving roller 16 is in contact with a secondary transfer roller 19 via the transfer belt 15. The contact portion between the secondary transfer roller 19 and the transfer belt 15 is a secondary transfer portion. The secondary transfer roller 19 is applied with a predetermined secondary transfer voltage at a predetermined control timing.

A fixing unit 20 and a discharge unit 21 are disposed at the upper portion on the right-hand side of the apparatus main body 1A. The upper surface of the apparatus main body 1A serves as a discharge tray 22.

The cartridges PY, PM, PC, and PK are mounted side by side in the arrangement direction AD. In this case, the rotational axes of the drums 3 of the respective cartridges P are disposed on a straight line drawn by a one-point chain line of FIG. 1.

<Cartridge Configuration>

Figure 4:
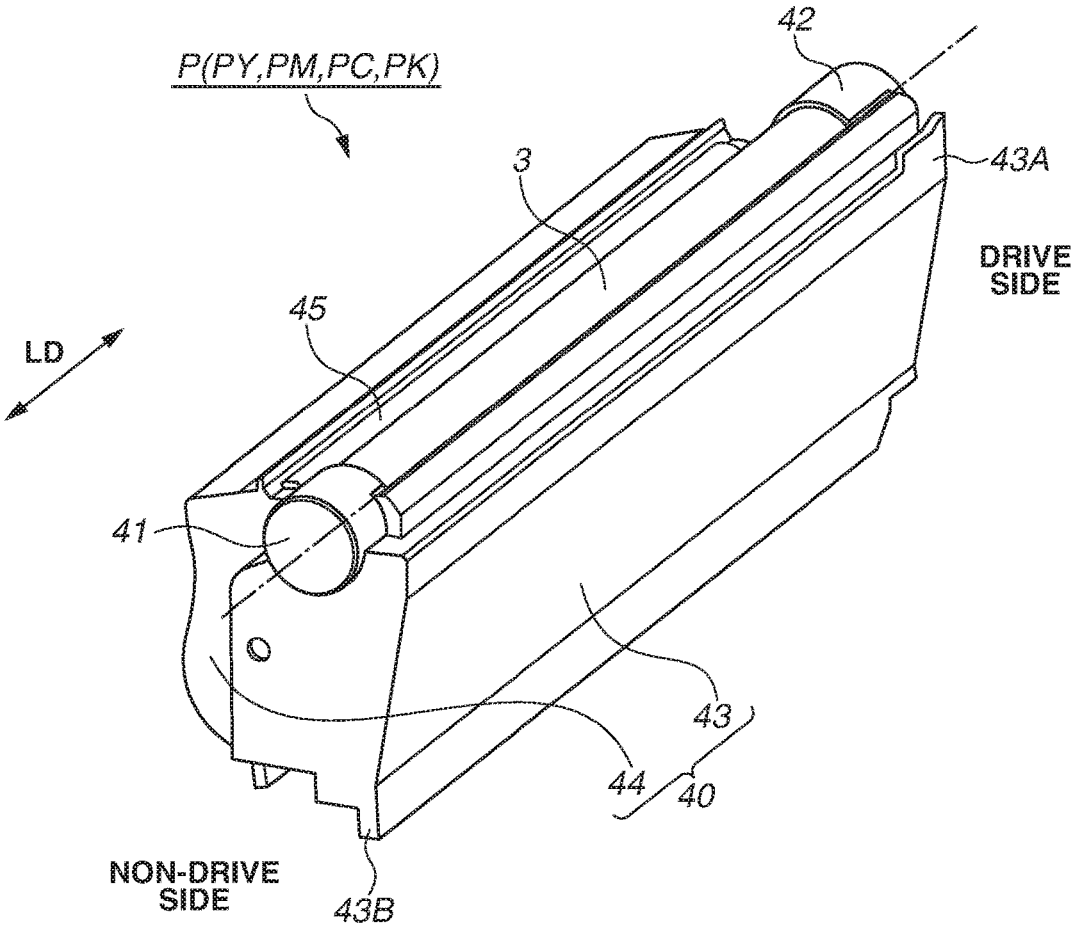
FIG. 4 is a perspective view illustrating an outer appearance of a process cartridge when viewed from a non-drive side.

FIG. 4 is a perspective view illustrating an outer appearance of the cartridge P when viewed from the non-drive side. The cartridge P is an assembly having the axial direction of the drum 3 as the longitudinal direction. A cartridge frame 40 includes a cleaning unit 43 and a development unit 44. The drum 3 is rotatably supported and disposed between a first bearing member (non-drive side) 41 and a second bearing member (drive side) 42, respectively, disposed at one end side and the other end side of the cleaning unit (photosensitive unit) 43. The developing roller 45 is rotatably supported by the development unit 44. The development unit 44 includes a developer container for storing toner. A cartridge upper rib 43A is formed at the upper part on the rear side (drive side) of the cleaning unit 43 in the longitudinal direction (LD). A cartridge lower rib 43B is formed at the lower part of the cleaning unit 43. The longitudinal direction of the development unit 44 is parallel to the axial direction of the developing roller 45 and parallel to the longitudinal direction LD of the cartridge P.

In the first cartridge PY, yellow (Y) toner is stored in the developer container, and a toner image of the Y color is formed on the surface of the drum 3. In the second cartridge PM, magenta (M) toner is stored in the developer container, and a toner image of the M color is formed on the surface of the drum 3. In the third cartridge PC, cyan C toner is stored in the developer container, and a toner image of the C color is formed on the surface of the drum 3. In the fourth cartridge PK, black (K) toner is stored in the developer container, and a toner image of the K color is formed on the surface of the drum 3.

<Methods for Replacing and Mounting Cartridge>

In the image forming apparatus according to the present exemplary embodiment, each cartridge P is replaced by front access, i.e., by opening a front door 2 serving as an opening/closing member of the apparatus main body 1A as illustrated in FIG. 3. A handle portion 2*a* is disposed at the front door 2. A sheet supplying cassette 10 is inserted and ejected by front access.

As illustrated in FIG. 3, to insert each cartridge P into the apparatus main body 1A and eject the cartridge P from the inside of the apparatus main body 1A, a front side plate 38 of the apparatus main body 1A is provided with an opening 24 for allowing the passage of the cartridge P (an opening for mounting and removing the cartridge P). The direction of mounting and removing the cartridge P on/from the apparatus main body 1A is the axial direction of the drum 3.

The front side plate 38 of the apparatus main body 1A is provided with the front door 2 as an opening/closing member which is movable between a close position at which the opening 24 is closed and an open position at which the opening 24 is open. A cartridge door for making it easier to mount the cartridge P is disposed between the front door 2 and the front side plate 38. The cartridge door 23 is opened and closed in association with the front door 2.

In the present exemplary embodiment, the front door 2 can take an open state where the opening 24 is open and a closed state where the opening 24 is closed, centering on a horizontal door rotational axis (a first rotational axis) 25 (refer to FIG. 2) disposed at the bottom side of the front door 2. The door rotational axis 25 is rotatably supported by a bearing member 26 disposed on the front plate 38 of the apparatus main body 1A. In the present exemplary embodiment, the door rotational axis is disposed with the axial direction horizontally extended in the right and left directions in consideration of door operability for the user. The front door 2 is closed so that a surface 2S covers the front side plate 38 of the apparatus main body 1A. The surface 2S can be changed from a rotation angle orientation in which the surface 2S is approximately parallel to the perpendicular direction to another rotation angle orientation in which the surface 2S is approximately horizontally opened, with the door rotational axis 25 as a fulcrum, by rotation of about 90 degrees toward the front side of the front side plate 38.

Figure 5A:
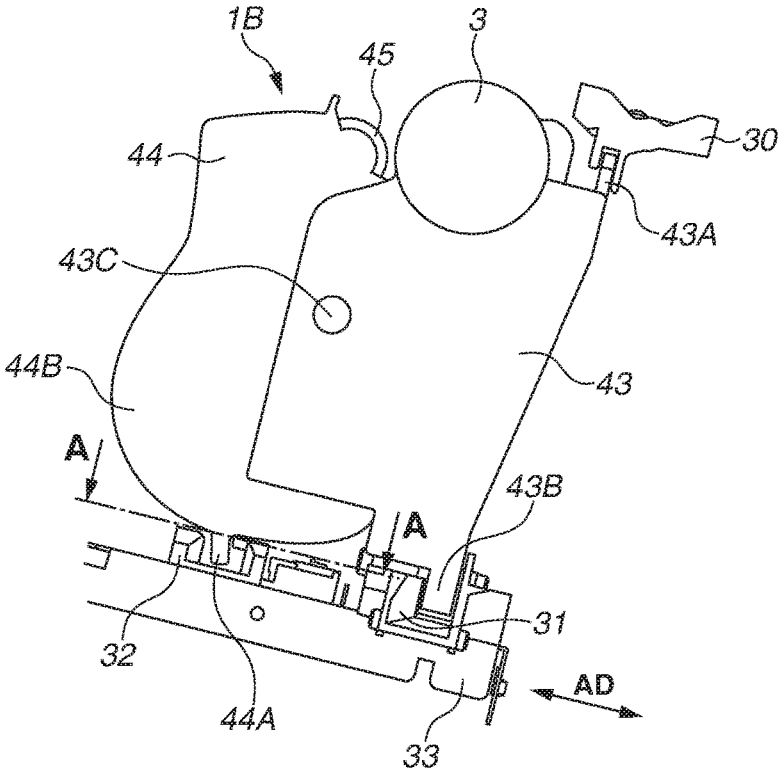
FIG. 5A illustrates a state where the process cartridge is being inserted halfway when viewed in an insertion direction.
Figure 5B:
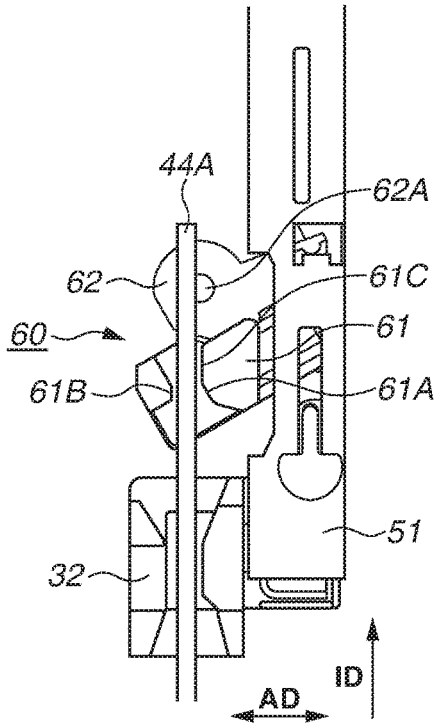
FIG. 5B is a cross-sectional view illustrating taken along the A-A line of FIG. 5A.
Figure 6:
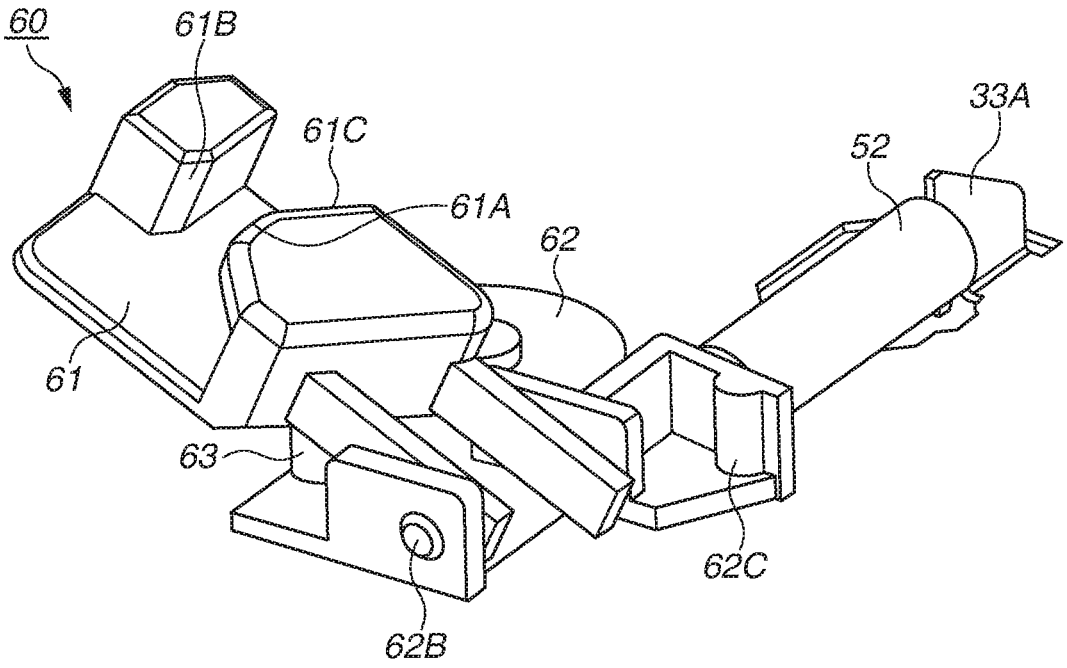
FIG. 6 illustrates details of a pressing unit.

A method for mounting and removing the cartridge P will be described below with reference to FIGS. 3, 5A, 5B, and 6. FIG. 5A illustrates each cartridge guide member when viewed from the axial direction of the drum 3. FIG. 5B is a cross-sectional view taken along the line A-A of FIG. 5A. The cross-section taken along the A-A line (one-point chain line) of FIG. 5A is parallel to the arrangement direction AD of the cartridge P. FIG. 6 is a perspective view illustrating a pressing unit 60.

In the cartridge storage unit 1B of the apparatus main body 1A (inside the image forming apparatus main body 1A), there are disposed a cartridge upper guide 30, a cartridge lower guide 31, and a developing guide 32 for guiding each of the first, the second, the third, and the fourth cartridges PY, PM, PC, and PK while being mounted and removed. When inserting the cartridge P into the cartridge storage unit 1B, the cartridge upper rib 43A and the cartridge lower rib 43B are inserted into (and pinched by) the cartridge upper guide 30 and the cartridge lower guide 31, respectively, disposed on the apparatus main body 1A (insertion process as the first process). The insertion direction ID that is the moving direction of the cartridge P when inserting the cartridge P into the cartridge storage unit 1B is parallel to the longitudinal direction (LD) of the cartridge P mounted on the apparatus main body 1A. Although the development unit 44 is configured to be rotatable centering on a developing rotation center 43C, the development unit 44 is inserted with a pressed portion 44A regulated by the developing guide 32. The pressed portion 44A is a portion downwardly protruding from a main body 44B of the development unit 44. In this way, the developing guide 32 regulates the movement of the development unit 44 in the direction perpendicularly intersecting with the insertion direction ID thereof. In the present exemplary embodiment, the direction perpendicularly intersecting with the insertion direction ID is the arrangement direction AD. When the cartridge P has been inserted into the cartridge storage unit 1B, the cartridge upper rib 43A and the cartridge lower rib 43B are held by holding portions (not illustrated) of the apparatus main body 1A.

FIG. 5B illustrate a state where the cartridge P is being inserted halfway. The development unit 44 is regulated by the developing guide 32 in the early stage of insertion. After the development unit 44 passes the developing guide 32, the development unit 44 is regulated by the pressing units 60 disposed at two different positions in the insertion direction ID and is inserted all the way to a predetermined position.

As illustrated in FIG. 6, the pressing unit 60 is composed of three parts: a pressing member 61, a pressing lever 62, and a development urging spring (urging member) 63. The pressing member 61 is attached to the pressing lever 62 and is rotatable centering on a rotation center 62B. The development urging spring 63 attached between the pressing member 61 and the pressing lever 62 urges the pressing member 61 toward the bottom of the development unit 44 to rotate the pressing member 61 centering on the rotation center 62B to make the tip portion follow the position of the bottom of the development unit 44. The pressing lever 62 is rotatably attached to a main stay 33 centering on a rotation boss 62A. The axis of rotation of the pressing lever 62 centering on the rotation boss 62A is an axis which intersects the insertion direction ID and is parallel to the positioning direction PD (described below) according to the present exemplary embodiment.

As illustrated in FIG. 5B, the pressing member 61 is provided with a regulation surface 61C, a first pressing surface (first pressing portion) 61B, and a second pressing surface (second pressing portion) 61A. The second pressing surface 61A and the regulation surface 61C are disposed to face the first pressing surface 61B in the arrangement direction AD across the pressed portion 44A of the development unit 44. These surfaces regulate the movement of the pressed portion 44A of the cartridge P being inserted halfway into the storage unit 1B in the arrangement direction AD. More specifically, the second pressing surface 61A, the first pressing surface 61B, and the regulation surface 61C constitute at least part of the regulating portion for regulating the movement of the cartridge P in the direction perpendicularly intersecting with the insertion direction ID (in the arrangement direction AD according to the present exemplary embodiment).

The pressing member 61 acts on the main stay 33 in association with the development unit 44 during the contact and separation operations of the cartridge P. Therefore, the pressing member 61 does not disturb the contact and separation operations. When the cartridge P has been inserted into the cartridge storage unit 1B, the pressed portion 44A and the developing guide 32 are set at different positions in the insertion direction ID. Therefore, the developing guide 32 does not disturb the contact and separation operations of the cartridge P (described below).

<Operation for Positioning Process Cartridge to Main Body>

Figure 7:
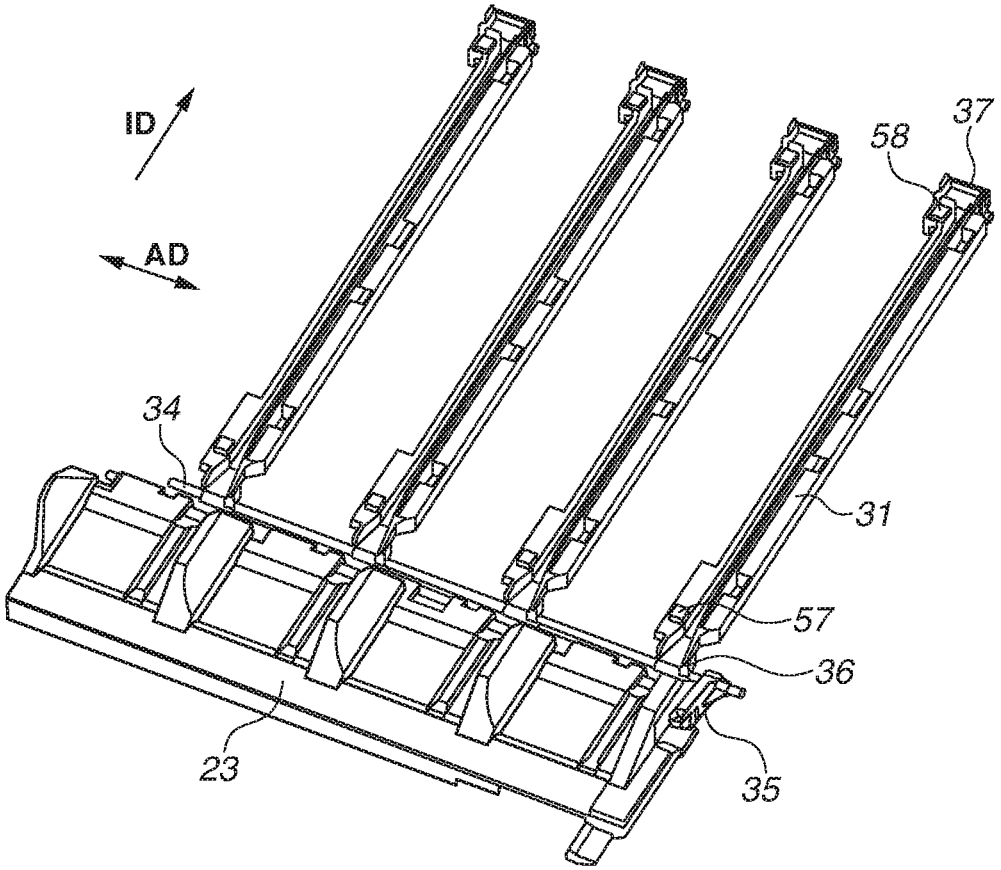
FIG. 7 illustrates an entire configuration of a positioning mechanism of the process cartridge.

A positioning operation after the cartridge P has been inserted into the apparatus main body 1A will be described below. FIG. 7 illustrates an overall configuration of a positioning mechanism for the process cartridges P.

As described above, the cartridge door 23 is configured to rotate centering on the axis of a rail shaft 34 in association with the front door 2 (refer to FIG. 3). The rail shaft 34 is connected with the cartridge door 23 via the link lever 35, and rotates in association with the operation of the cartridge door 23. The cartridge lower guide 31 is attached to the rail shaft 34 via a front side rail arm 36. The cartridge lower guide 31 is also connected with a rear side rail arm 37 rotating in phase with the front side rail arm 36. Therefore, the cartridge lower guide 31 can move in the positioning direction PD in association with the front door 2.

Figure 8:
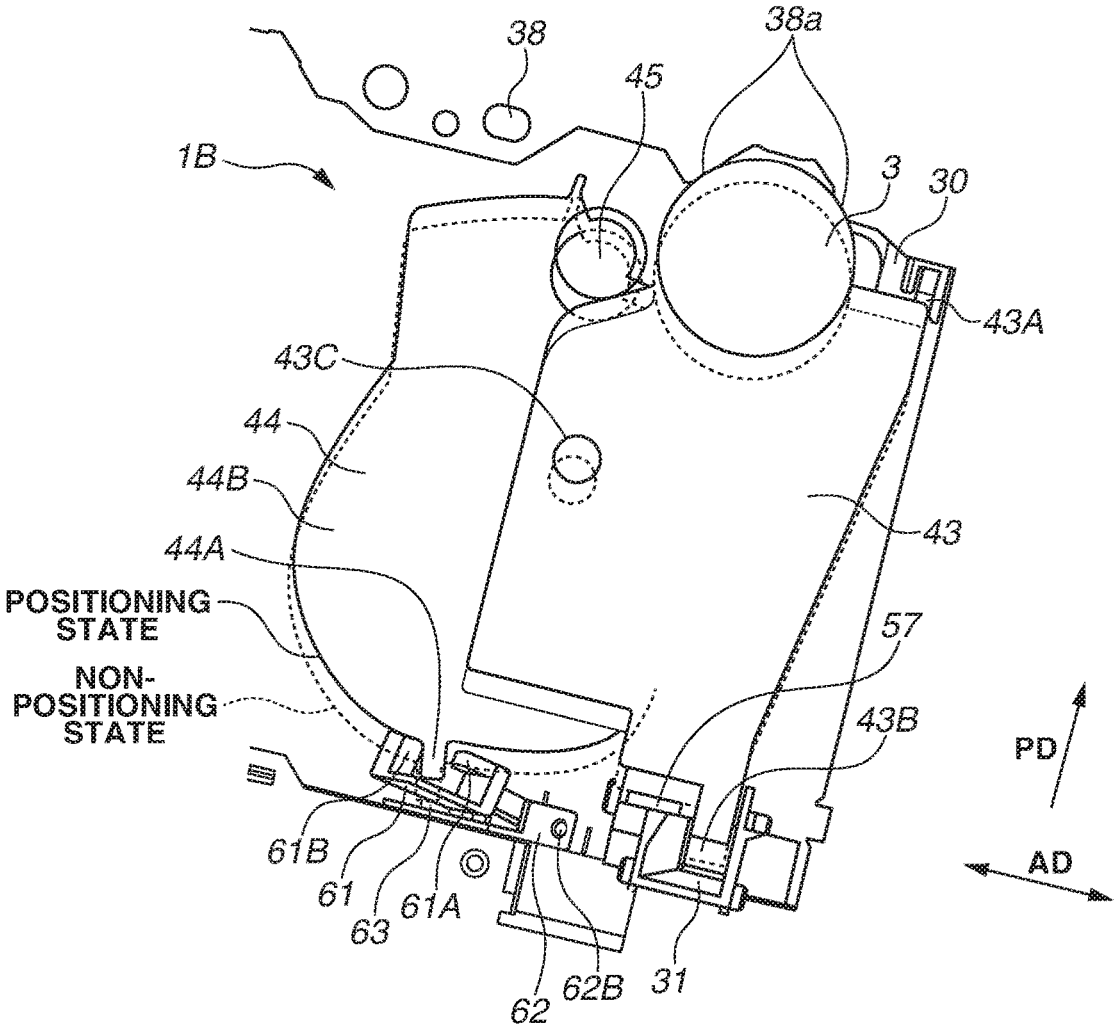
FIG. 8 illustrates a positioning state and a non-positioning state of the process cartridge.

FIG. 8 illustrates a positioning state and a non-positioning state of the cartridge P when viewed from the axial direction of the drum 3. Referring to FIG. 8, the solid lines indicate a state where the cartridge P has been positioned to the apparatus main body 1A (positioning state), and the dashed lines indicate a state where the cartridge P has been inserted into the cartridge storage unit 1B but has not been positioned to the apparatus main body 1A (non-positioning state).

Where the cartridge P has been inserted into the apparatus main body 1A, the cartridge P is still in the non-positioning state. When the user closes the front door 2 in this state, the cartridge lower guide 31 (upwardly) moves in the positioning direction PD in association with the close operation of the front door 2. Then, the cartridge P enters the positioning state (positioning process as the second process). The cartridge lower guide 31 is provided with a front side pressurizing convex 57 and a rear side pressurizing convex 58 (refer to FIG. 7) at two different positions in the insertion direction ID. The front side pressurizing convex 57 and the rear side pressurizing convex 58 upwardly pressurize the cartridge P to abut the cartridge P against each of the positioning portion 38*a* of the front side plate 38 and the positioning portion of the rear side plate (not illustrated) to turn the cartridge P into the positioning state.

The positioning direction (first direction) PD is a direction parallel to the direction in which the pressing member 61 and the development unit 44 are arranged from the pressing member 61 towards the development unit 44 (the direction in which the development unit 44 separates from the pressing member 61). In the present exemplary embodiment, the direction perpendicularly intersecting with the arrangement direction AD and the insertion direction ID is set as the positioning direction PD. The direction in which the pressed portion 44A protrudes from the main body 44B of the development unit 44 is the direction toward the pressing member 61 (an approximately opposite direction of the positioning direction PD), i.e., an approximately downward direction according to the present exemplary embodiment.

When the cartridge P moves in the positioning direction PD, the pressing member 61 rotates centering on the rotation center 62B since the pressing member 61 is urged toward the development unit 44 by the development urging spring 63. Therefore, with the movement of the development unit 44 of the cartridge P in the positioning direction PD, the second pressing surface 61A and the first pressing surface 61B of the pressing member 61 move in the positioning direction PD following the movement of the development unit 44 in the positioning direction PD. Therefore, when the cartridge P is in the positioning state, the pressing member 61 is in contact with the cartridge P.

<Contact and Separation Mechanism of Main Body and Operations>

Figure 9:
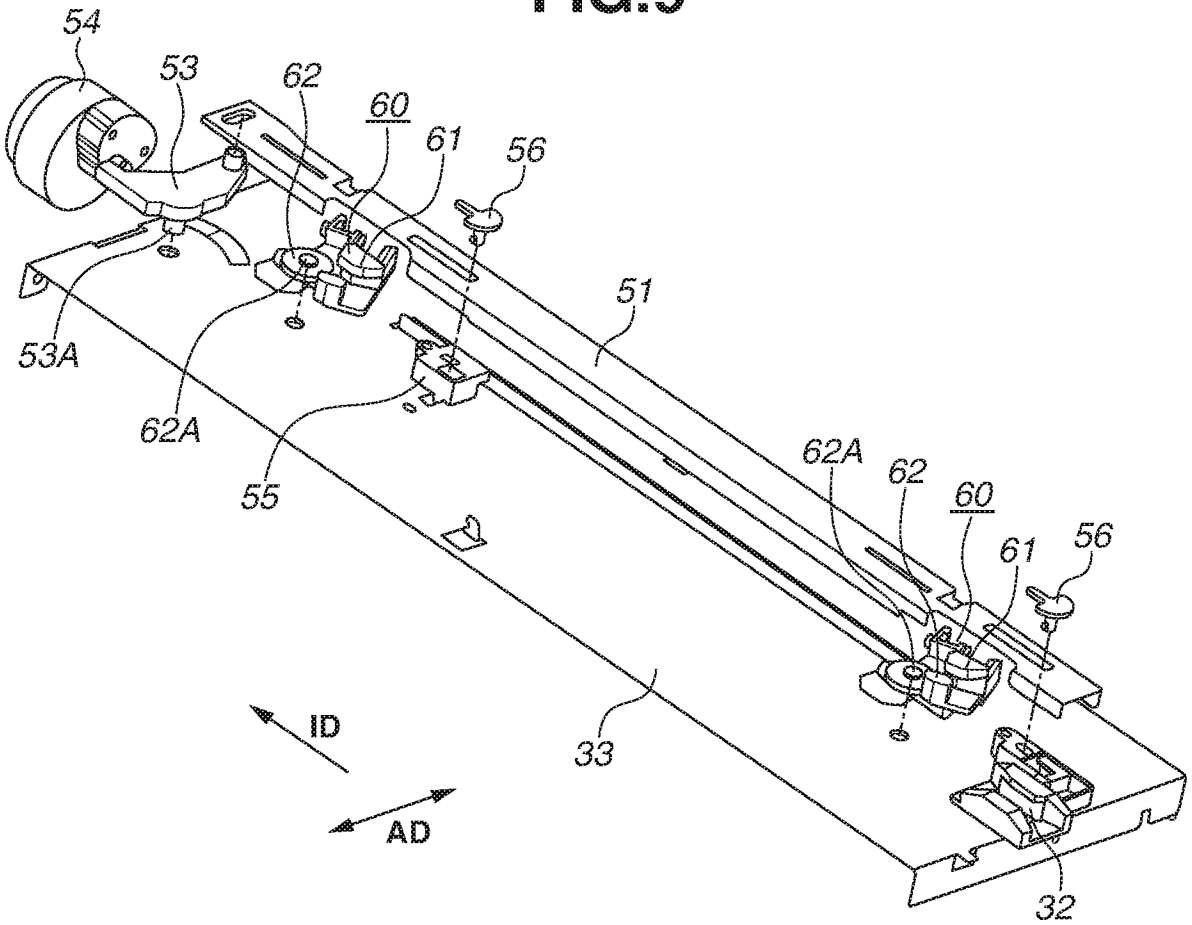
FIG. 9 illustrates an entire configuration of a contact and separation mechanism of an apparatus main body.
Figure 10A:
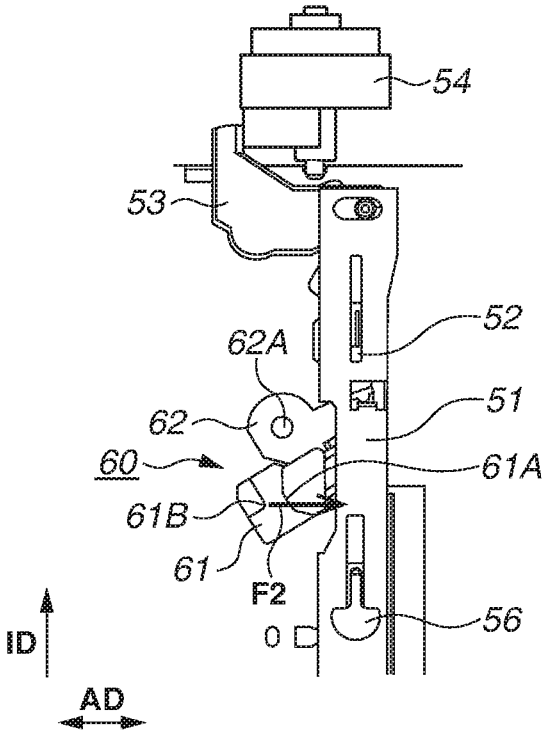
FIGS. 10A and 10B illustrate operations of the contact and separation mechanism of the apparatus main body.
Figure 10B:
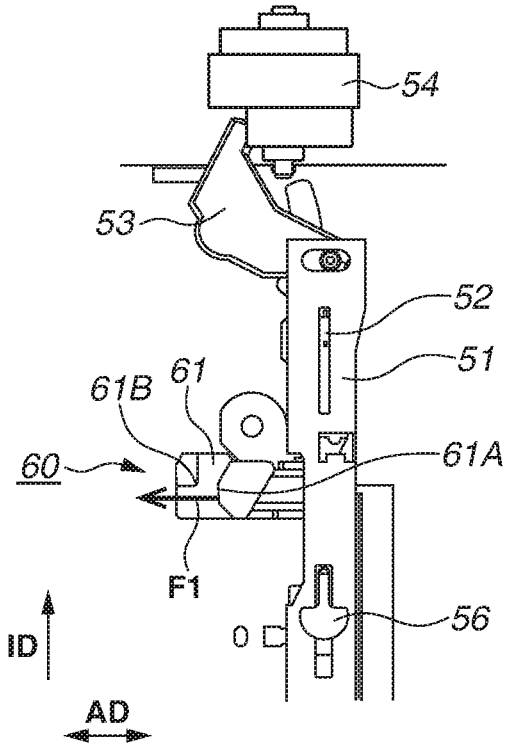

The contact and separation mechanism provided in the apparatus main body 1A will be described below with reference to FIGS. 9 and 10. FIG. 9 is an exploded perspective view illustrating an overall configuration of the contact and separation mechanism of the apparatus main body 1A. FIGS. 10A and 10B illustrate the contact and separation mechanism when viewed from the opposite direction of the positioning direction PD.

The contact and separation mechanism mainly includes the pressing unit 60, a sliding member 51, a developing pressure spring 52, a separation lever 53, a separation cam 54, and a slide cap 56 which are all provided for each cartridge P. Therefore, the contact and separation mechanism corresponding to one cartridge P will be described below. The contact and separation mechanisms corresponding to other cartridges P have a similar configuration, and redundant descriptions thereof will be omitted. FIG. 9 illustrates only the contact and separation mechanism corresponding to the cartridge PK, and descriptions of the contact and separation mechanisms corresponding to other cartridges P will be omitted.

As illustrated in FIG. 9, the pressing unit 60 is rotatably attached centering on the rotation boss 62A to two different positions disposed in line in the insertion direction on the main stay 33. The sliding member 51 is attached onto the main stay 33 via the developing guide 32 and a slide bearing 55, and can be slid only in the insertion direction ID. To prevent the slide member 51 from being removed, the slide member 51 is sandwiched between the slide bearing 55 and the slide cap 56 attached to the slide bearing 55. The separation lever 53 is a member for connecting the separation cam 54 and the sliding member 51, and is rotatable centering on a rotation boss 53A on the main stay 33.

The contact and separation mechanism takes two different positions: a contact position for turning the cartridge P into the contact state and a separation position for turning the cartridge P into the separation state. The pressurizing operation of the pressing unit 60 will be described below with reference to FIGS. 10A and 10B. FIG. 10A illustrates a state where the contact and separation mechanism is in the separation state. FIG. 10B illustrates a state where the contact and separation mechanism of the apparatus main body 1A is in the contact state. When changing the cartridge P to the contact state, as illustrated in FIG. 10B, the developing pressure spring allows the second pressing surface (second pressing portion) 61A of the pressing member 61 to press the pressed portion 44A of the development unit 44 (refer to FIG. 8) in the direction of the arrow F1.

When changing the cartridge P from the contact state to the separation state, a first pressing surface (first pressing portion) 61B of the pressing member 60 presses the pressed portion 44A of the development unit 44 in the direction of the arrow F2 opposite to the direction of the arrow F1. Since the developing pressure spring 52 is provided in the apparatus main body 1A, the cartridge P is not subject to the force from the developing pressure spring 52 except for in the contact state. Therefore, the cartridge P is prevented from being creep-deformed by the force received from the developing pressure spring 52.

<Contact and Separation Operations of Cartridge>

The contact and separation operations of the cartridge P will be described in detail below with reference to FIGS. 11A to 16C.

An operation for changing the process cartridge P from the separation state to the contact state will be described below with reference to FIGS. 11A to 13C.

The separation state refers to a state where the developing roller 45 is separated from the drum 3 by a predetermined distance or more. The contact state refers to a state where the developing roller 45 is in pressure contact with the drum 3. The intermediate state refers to a state where the developing roller 45 is separated from the drum 3 by less than the predetermined distance. The cartridge P passes the intermediate state when shifting between the contact state and the separation state. When the cartridge P is in the contact state, toner borne on the surface of the developing roller 45 can be made adhere to the surface of the drum 3, and a latent image formed on the drum 3 can be developed with the toner.

Figure 11A:
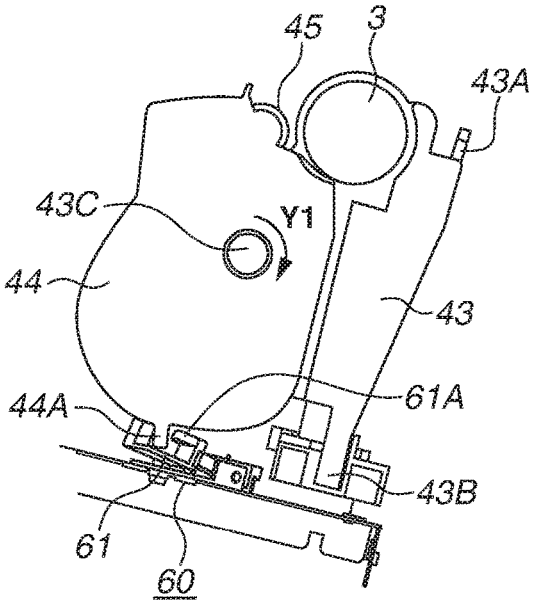
FIGS. 11A, 11B, and 11C illustrate a process in which the process cartridge changes from a separation state to a contact state.
Figure 11B:
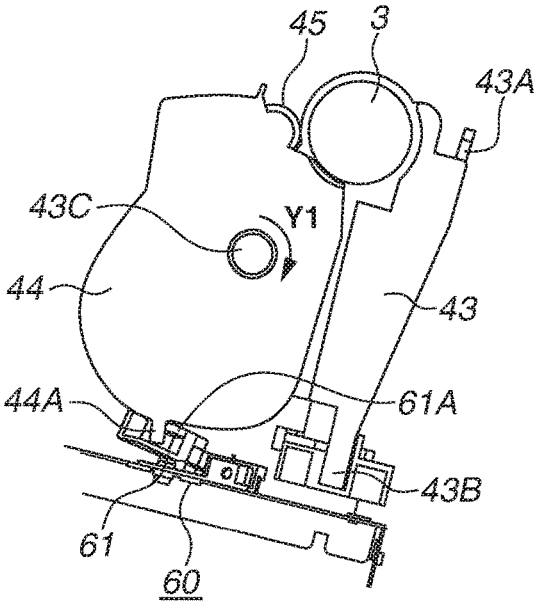
Figure 11C:
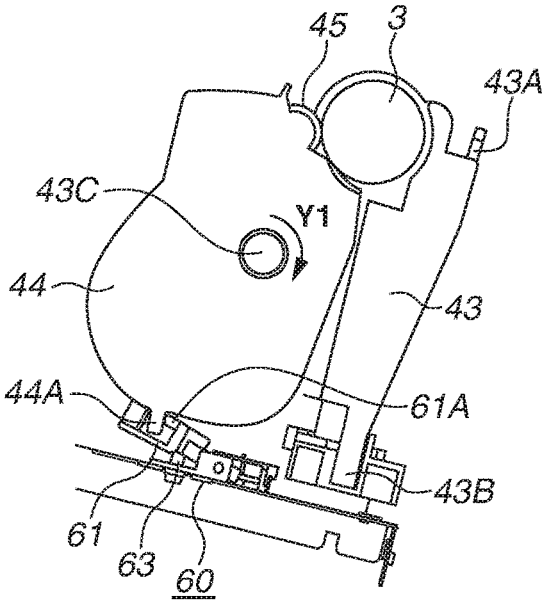
Figure 12A:
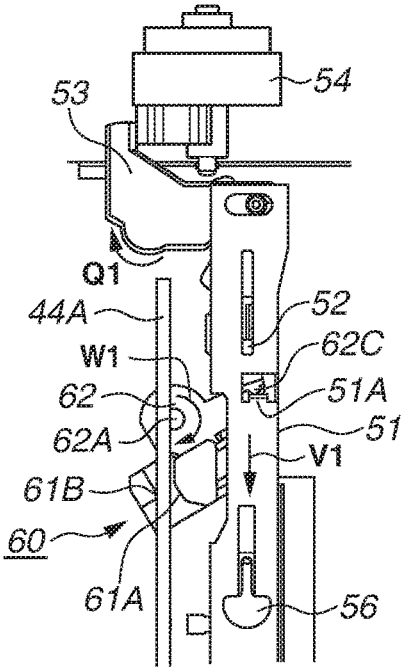
FIGS. 12A, 12B, and 12C illustrate a process in which the contact and separation mechanism of the apparatus main body changes from a separation state to a contact state.
Figure 12B:
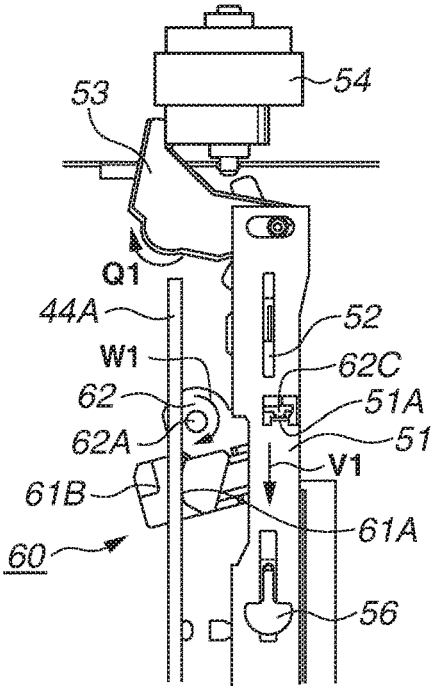
Figure 12C:
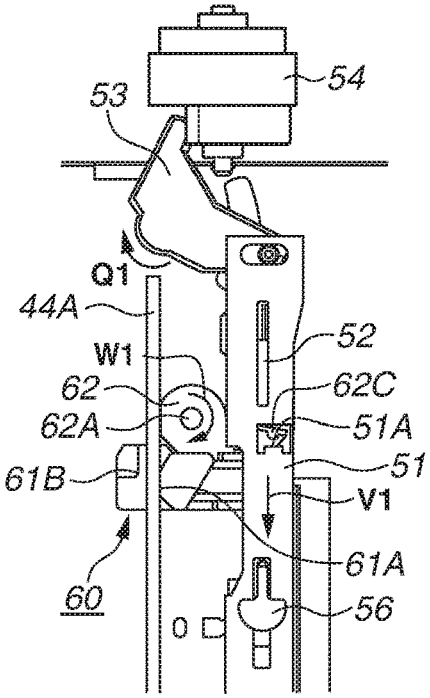
Figure 13A:
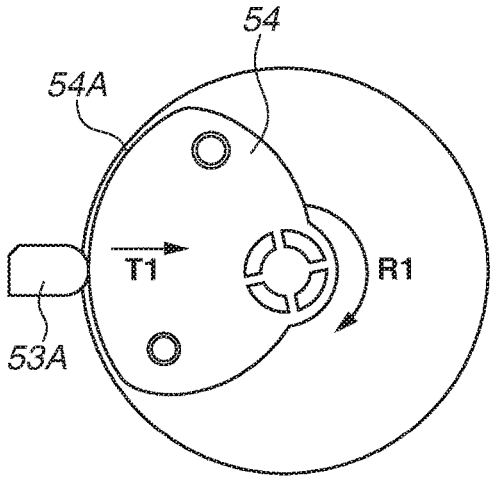
FIGS. 13A, 13B, and 13C illustrate a relation between a separation lever and a separation cam during a state transition of the contact and separation mechanism from the separation state to the contact state.
Figure 13B:
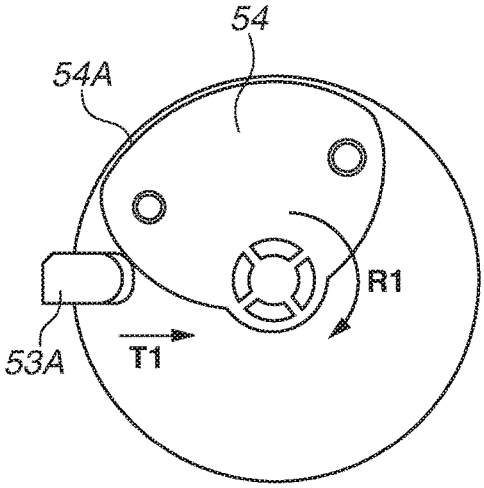
Figure 13C:
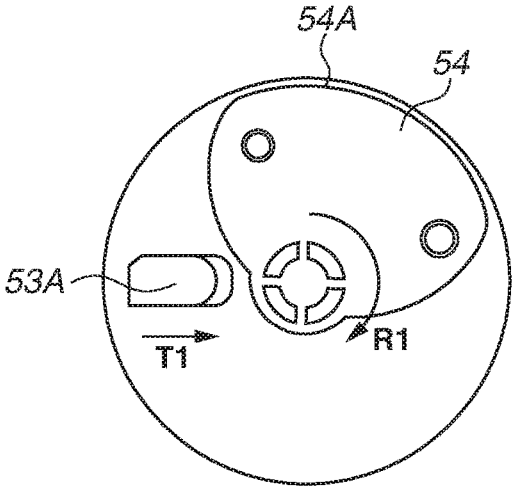

FIGS. 11A, 11B, and 11C illustrate a state transition of the cartridge P from the separation state to the contact state when viewed in the insertion direction ID. FIG. 11A illustrates the separation state, FIG. 11B illustrates the intermediate state, and FIG. 11C illustrates the contact state. FIGS. 12A, 12B, and 12C illustrate a state transition of the contact and separation mechanism from the separation state to the contact state when viewed from the opposite direction of the positioning direction PD. FIG. 12A illustrates the separation state, FIG. 12B illustrates the intermediate state, and FIG. 12C illustrates the contact state. FIGS. 13A, 13B, and 13C illustrate a relation between the separation lever 53 and the separation cam 54 during a state transition of the contact and separation mechanism from the separation state to the contact state when viewed in the insertion direction ID. FIG. 13A illustrates the separation state, FIG. 13B illustrates the intermediate state, and FIG. 13C illustrates the contact state.

In the separation states illustrated in FIGS. 11A, 12A, and 13A, the pressing member 61 is constantly urged in the direction of the arrow W1 by the pressurizing force of the developing pressure spring 52. A bending portion 51A of the sliding member 51 receives the pressurizing force of the developing pressure spring 52 from a hooking portion 62C of the pressing lever 62, and is constantly urged in the direction of the arrow V1. Similarly, the separation lever 53 engaging with the sliding member 51 is constantly urged in the direction of the arrow Q1, and an arm 53A of the separation lever 53 is constantly urged in the direction of the arrow T1 illustrated in FIG. 13A to abut against the outer circumferential surface (cam surface) 54A of the separation cam 54. When the arm 53A abuts against the outer circumferential surface 54A and the position of the separation lever 53 is determined, the positions of the sliding member 51 and the pressing member 61 are also determined.

When a separation motor (not illustrated) is driven from the separation state, the separation cam 54 starts rotating in the direction of the arrow R1, as illustrated in FIG. 13B. When the separation cam 54 starts rotating, the arm 53A moves in the T1 direction while sliding on the outer circumferential surface 54A of the separation cam 54 by the pressurizing force of the developing pressure spring 52. Then, the separation lever 53 rotates in the direction of the arrow Q1 on the main stay 33, and the sliding member 51 slides in the direction of the arrow V1. At the same time, the pressing member 61 rotates in the direction of the arrow W1 on the main stay 33. Then, as illustrated in FIG. 11B, the second pressing surface 61A presses the pressed portion 44A of the development unit 44, and the development unit 44 rotates in the direction of the arrow Y1 centering on the rotation center 43C. When the separation cam 54 further rotates in the direction of the arrow R1 from this state, the developing roller 45 is brought into contact with the drum 3 at a predetermined contact pressure by the pressurizing force of the developing pressure spring 52 transmitted via the second pressing surface 61A, as illustrated in FIG. 11C. In the contact state, as illustrated in FIG. 13C, there is a predetermined gap between the separation cam 54 and the separation lever 53. This configuration enables converting the pressurizing force of the developing pressure spring 52 into a force for pressurizing the developing roller 45 onto the drum 3 with little loss.

The pressing member 61 is constantly urged by the development urging spring 63 so that the pressing member 61 can follow the movement of the bottom surface of the development unit 44. Therefore, the second pressing surface 61A of the pressing member 61 can press a portion which is hardly deformed in the vicinity of the root of the pressed portion 44A of the development unit 44. Therefore, the configuration in which the second pressing surface 61A presses a portion in the vicinity of the root of the pressed portion 44A enables restricting the elastic deformation and temporal creep deformation of the pressed portion 44A pressed by the second pressing surface 61A, compared with the configuration in which the tip of the pressed portion 44A is pressed. Therefore, this configuration enables restricting the loss of the contact pressure of the developing roller 45 onto the photosensitive drum 3.

Figure 14A:
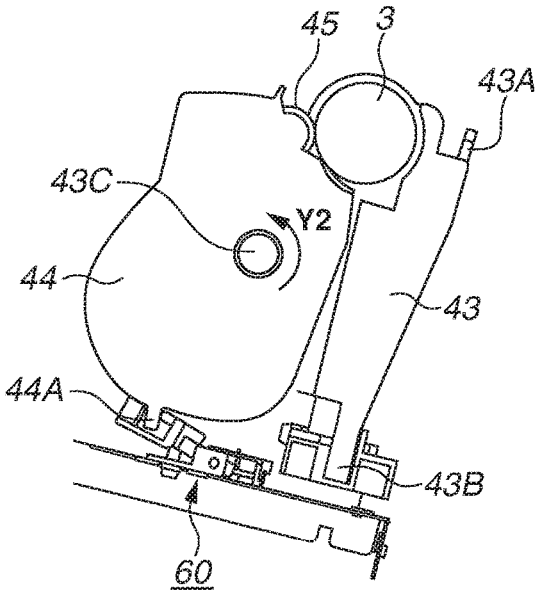
FIGS. 14A, 14B, and 14C illustrate a process in which the process cartridge changes from the contact state to the separation state.
Figure 14B:
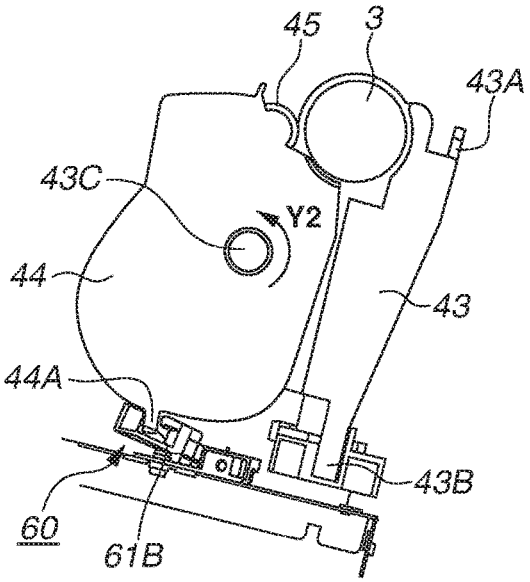
Figure 14C:
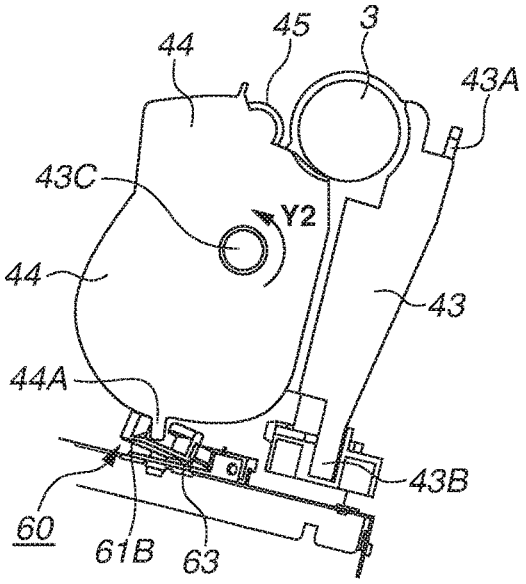
Figure 15A:
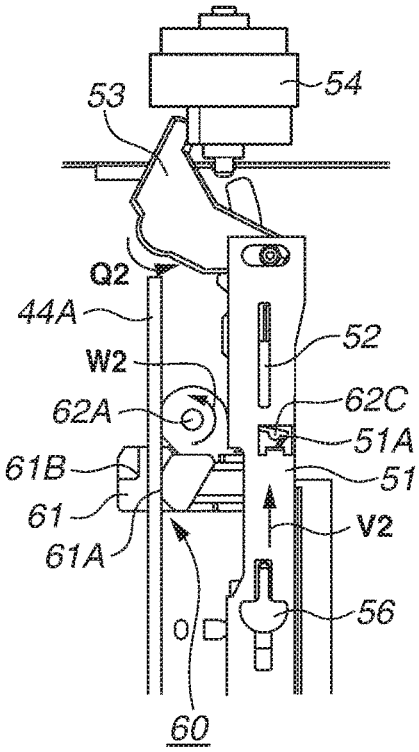
FIGS. 15A, 15B, and 15C illustrate a process in which the contact and separation mechanism of the apparatus main body changes from the contact state to the separation state.
Figure 15B:
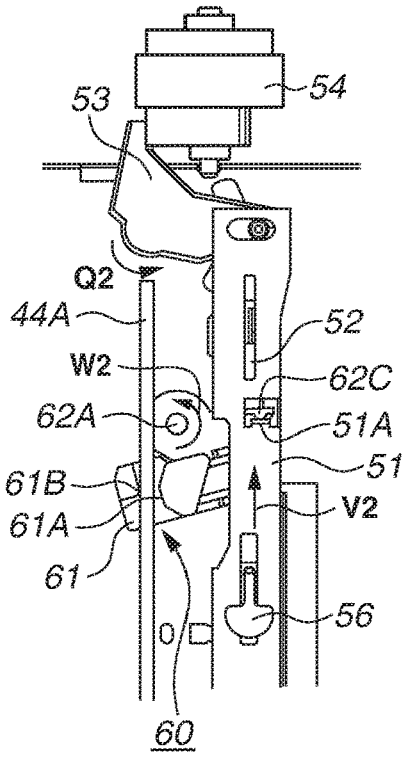
Figure 15C:
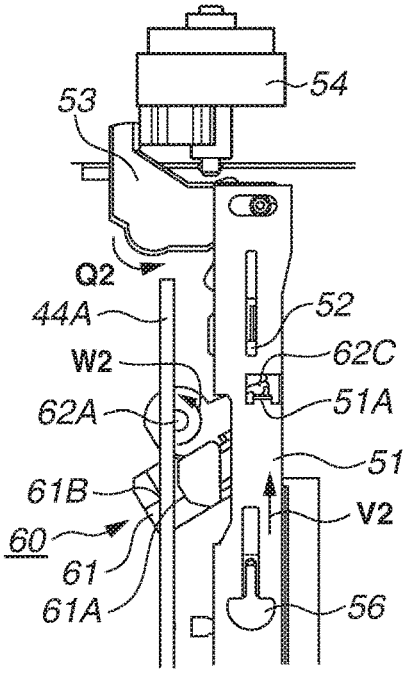
Figure 16A:
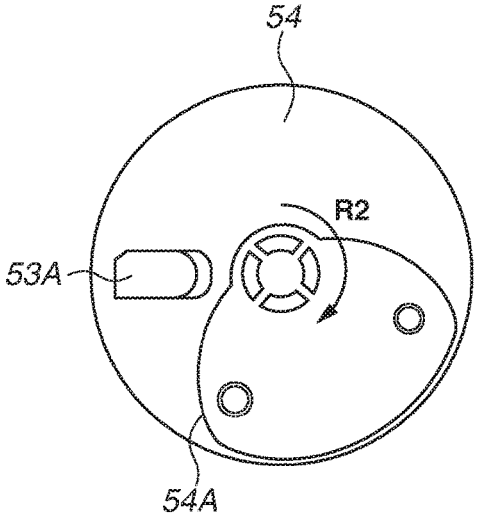
FIGS. 16A, 16B, and 16C illustrate a relation between the separation lever and the separation cam during a state transition of the contact and separation mechanism from the contact state to the separation state.
Figure 16B:
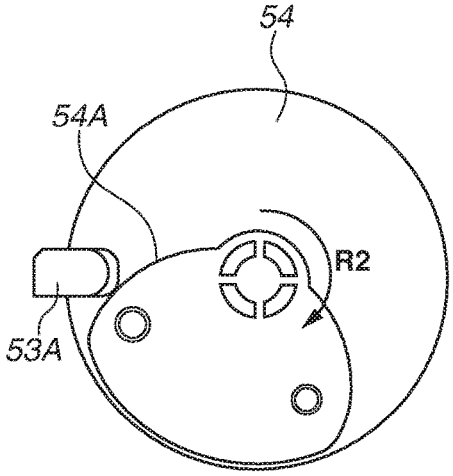
Figure 16C:
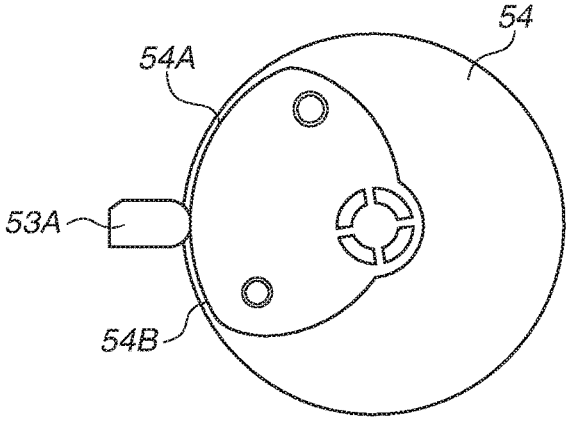

Operations for changing the cartridge P from the contact state to the separation state will be described below with reference to FIGS. 14A to 16C. FIGS. 14A, 14B, and 14C illustrate a state transition of the cartridge P from the contact state to the separation state when viewed in the insertion direction ID. FIG. 14A illustrates the contact state, FIG. 14B illustrates the intermediate state, and FIG. 14C illustrates the separation state. FIGS. 15A, 15B, and 15C illustrates a state transition of the contact and separation mechanism of the apparatus main body 1A from the contact state to the separation state when viewed from the opposite direction of the positioning direction PD. FIG. 15A illustrates the contact state, FIG. 15B illustrates the intermediate state, and FIG. 15C illustrates the separation state. FIGS. 16A, 16B, and 16C illustrate a relation between the separation lever 53 and the separation cam 54 during a state transition of the contact and separation mechanism from the contact state to the separation state when viewed in the insertion direction ID. FIG. 16A illustrates the contact state, FIG. 16B illustrates the intermediate state, and FIG. 16C illustrates the separation state.

When a motor (not illustrated) is driven from the contact state illustrated in FIGS. 14A, 15A, and 16A, the separation cam 54 starts rotating in the direction of the arrow R2 as illustrated in FIG. 16B. When the separation cam 54 starts rotating, the arm 53A of the separation lever 53 slides on a slope 54A of the separation cam 54, and the separation lever 53 starts rotating in the direction of the arrow Q2 on the main stay 33, as illustrated in FIG. 15B. Therefore, the sliding member 51 is pressed by the separation lever 53 to slide in the direction of the arrow V2. Accordingly, as illustrated in FIG. 15B, the pressing member 61 is pressed by the sliding member 51 to start rotating in the direction of the arrow W2 on the main stay against the urging force of the developing pressure spring 52. Accordingly, the first pressing surface 61B of the pressing member 61 presses the pressed portion 44A of the development unit 44, and the development unit 44 rotates in the direction of the arrow Y2 centering on the rotation center 43C. When the separation cam 54 further rotates from this state, the arm 53A of the separation lever 53 slides all the way to the outermost diameter surface 54B out of the outer circumferential surface 54A of the separation cam 54, as illustrated in FIG. 16C. When the developing roller 45 separates from the photosensitive drum 3 by the predetermined distance, the separation from the photosensitive drum 3 is completed (the state illustrated in FIG. 14C).

The pressing member 61 is constantly urged by the development urging spring 63 so that the pressing member 61 can follow the movement of the bottom surface of the development unit 44. Therefore, the first pressing surface 61B of the pressing member 61 can press a point which is hardly deformed in the vicinity of the root of the pressed portion 44A of the development unit 44. Therefore, the configuration in which the first pressing surface 61B presses a portion in the vicinity of the root of the pressed portion 44A enables restricting the elastic deformation and temporal creep deformation of the pressed portion 44A pressed by the first pressing surface 61B, compared with the configuration in which the tip of the pressed portion 44A is pressed. Therefore, this configuration enables restricting the loss of the amount of separation of the developing roller 45 from the photosensitive drum 3.

According to the present exemplary embodiment, when the cartridge P is in the positioning state, the development urging spring 63 urges the pressing member 61 to abut it against the bottom of the development unit 44, allowing the first pressing surface 61B and the second pressing surface 61A to press a portion that is hardly deformed in the vicinity of the root of the pressed portion 44A. However, when the cartridge P is in the positioning state, the development urging spring 63 does not necessarily need to abut the pressing member 61 against the bottom of the development unit 44. More specifically, when the cartridge P is in the positioning state, if the pressing member 61 is disposed more on the downstream side in the positioning direction PD than the pressing member 61 is when the cartridge P is in the non-positioning state, the pressing member 61 can press a portion closer to the root of the pressed portion 44A. This configuration enables restricting the loss of the contact pressure of the developing roller 45 onto the photosensitive drum 3 and the loss of the amount of separation of the developing roller 45 from the photosensitive drum 3.

According to the present exemplary embodiment, the two pressing units 61 are disposed in line in the insertion direction ID for each cartridge P, and the two pressing units 61 are connected with one sliding member 51. Naturally, three or more pressing units 61 may be disposed for each cartridge P. If the pressing unit 61 is configured so that the uniformity of the contact pressure and separation amount is unlikely to become uneven in the longitudinal direction of the developing roller 45, only one pressing unit 61 may be provided for each cartridge P. When two pressing units 61 are provided, two sliding members 51 corresponding to the two pressing units 61 may be provided instead of a configuration in which the two pressing units 61 are moved by one sliding member 51.

In the present exemplary embodiment, the cartridge P integrally mounts and removes the cleaning unit 43 and the development unit 44 on/from the apparatus main body 1A. However, the configuration of the cartridge P is not limited thereto. More specifically, the cartridge P may be configured so that only the development unit 44 can be removed from the apparatus main body 1A without removing the cleaning unit 43 from the apparatus main body 1A. For example, the development unit 44 is configured as a first cartridge P1 and the cleaning unit 43 is configured as a second cartridge P2, and the first cartridge P1 may be configured to be separately mounted on and removed from the apparatus main body 1A while leaving the second cartridge P2 in the apparatus main body 1A.

Figure 17A:
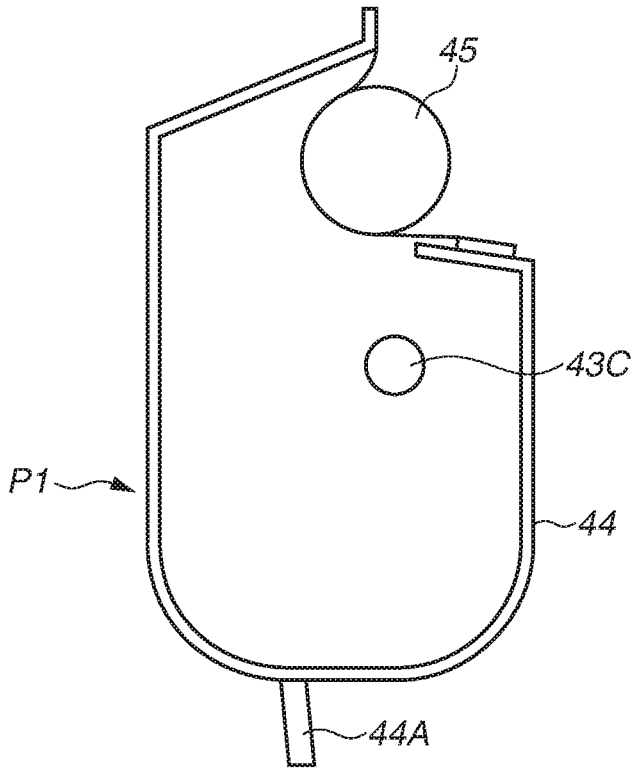
FIG. 17A is a cross-sectional view schematically illustrating a first cartridge.
Figure 17B:
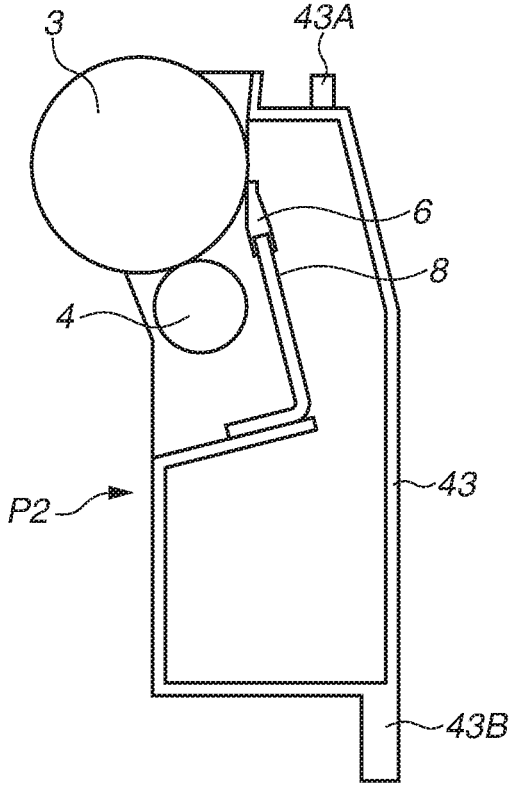
FIG. 17B is a cross-sectional view schematically illustrating a second cartridge.

FIG. 17A is a cross-sectional view schematically illustrating the first cartridge P1 when viewed from the direction of the rotational axis of the developing roller 45. FIG. 17B is a cross-sectional view schematically illustrating the second cartridge P2 when viewed from the direction of the rotational axis of the drum 3. Elements having identical functions to those in the above-described exemplary embodiment are assigned the same reference numerals. When the first cartridge P1 is mounted on the apparatus main body 1A, the first cartridge P1 is rotatably held by holding portions (not illustrated) of the apparatus main body 1A centering on the developing rotation center 43C. With the second cartridge P2, the cartridge upper rib 43A and the cartridge lower rib 43B are held by holding portions (not illustrated) of the apparatus main body 1A.

The pressed portion 44A may be pressed by the first pressing surface 61B during the process of inserting the cartridge P into the apparatus main body 1A (during execution of the first process). This enables preventing the developing roller 45 and the photosensitive drum 3 from coming into contact and interfering with each other and getting damaged in the insertion process, even without providing other regulation portions for regulating the position of the development unit 44.

In the above-described configuration, the pressing member 61 can press a portion that is hardly deformed in the vicinity of the root of the pressed portion 44A of the development unit 44 to bring the developing roller 45 into contact with the photosensitive drum 3 or separate the developing roller 45 from the photosensitive drum 3. This configuration enables restricting the deformation of the pressed portion 44 of the development container, enables restricting the loss of the contact pressure and the loss of the separation amount of the developing roller 45, and enables reducing the moving amount of the pressing member 61 and the size of the apparatus main body 1A.

According to the present exemplary embodiment, the pressing member 61 can press the cartridge P to separate the developing roller 45 from the drum 3 and press the cartridge P to bring the developing roller 45 into contact with the drum 3 by a predetermined pressure. Therefore, even if the cartridge P does not have an elastic member for bringing the developing roller 45 into contact with the drum 3, the developing roller 45 can be brought into contact with and separated from the drum 3. Naturally, the present exemplary embodiment is also applicable to a configuration in which the cartridge P has an elastic member for bringing the developing roller 45 into contact with the drum 3. In this case, the pressing force by the pressing member 61 can be obtained when bringing the developing roller 45 into contact with the drum 3. Therefore, it becomes possible to weaken the urging force of the elastic member compared with a configuration in which the developing roller 45 is brought into contact with the drum 3 only by the elastic member.

When inserting the development unit 44, the pressing member 61 can restrict the movement of the development unit 44 in the direction perpendicularly intersecting with the insertion direction ID to guide the insertion. This enables reducing the number of regulation members (guide members) dedicated for regulation (guidance), thus reducing the cost and size of the image forming apparatus. Particularly in a configuration in which the cleaning unit 43 and the development unit 44 can be separately removed from the apparatus main body 1A, it is necessary to regulate each of the cleaning unit 43 and the development unit 44. In this case, therefore, the present exemplary embodiment is more effective in reducing the cost and size of the image forming apparatus.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus comprising:

a development cartridge including a developing member;

a photosensitive cartridge including a photosensitive member;

a mounting unit configured to mount the development cartridge and the photosensitive cartridge, the development cartridge and the photosensitive cartridge each being attachable to and detachable from the mounting unit in a longitudinal direction thereof;

a pressing member configured to press and move the development cartridge in a first direction intersecting with the longitudinal direction of the developing member, for separating the developing member from the photosensitive member or bringing the developing member into contact with the photosensitive member, in a state where the development cartridge and the photosensitive cartridge are mounted on the mount unit; and an urging member configured to urge the pressing member in a second direction intersecting with both the longitudinal direction and the first direction, wherein, when mounting the development cartridge onto the mounting unit, the development cartridge is moved in the second direction together with the pressing member by the urging member.

2. The image forming apparatus according to claim 1, wherein, in a state where the development cartridge is mounted on the mounting unit, the pressing member urged by the urging member is in contact with the development cartridge.

3. The image forming apparatus according to claim 1, wherein the development cartridge has a pressed portion to be pressed by the pressing member, and the pressed portion is a portion protruding from a main frame of the development cartridge.

4. The image forming apparatus according to claim 1, wherein, when mounting the development unit onto the mounting unit, a mounting of the development unit is completed through a first process for moving the development unit in the longitudinal direction and a second process for moving the development unit in the second direction after performing the first process.

5. The image forming apparatus according to claim 4, wherein the pressing member presses the development unit during execution of the first process.

6. The image forming apparatus according to claim 1, wherein the pressing member has a pressing portion for pressing the development cartridge mounted on the mounting unit in order to separate the developing member from the photosensitive member, and an another pressing portion for pressing the development cartridge mounted on the mounting unit to bring the developing member into contact with the photosensitive member.

7. The image forming apparatus according to claim 1, further comprising:

another pressing member for pressing the development unit mounted on the mounting unit to separate the developing member from the photosensitive member or bring the developing member into contact with the photosensitive member, wherein the pressing member and the another pressing member are disposed in line along the longitudinal direction.

8. The image forming apparatus according to claim 1, wherein the pressing member rotates around an axis intersecting with the longitudinal direction to press the development unit.

9. The image forming apparatus according to claim 1, wherein the mounting unit can mount a plurality of the development units.

10. The image forming apparatus according to claim 1, wherein the urging member includes an urging spring for urging the pressing member in the second direction.

* * * * *